United States Patent [19]

Bogstad

[11] Patent Number: 4,896,144

[45] Date of Patent: Jan. 23, 1990

[54] HAND WASHING ALERT

[76] Inventor: Naomi C. Bogstad, 1124 Virgilina Ave., Norfolk, Va. 23503

[21] Appl. No.: 250,536

[22] Filed: Sep. 29, 1988

[51] Int. Cl.[4] ..... G08B 7/00

[52] U.S. Cl. ..... 340/691; 340/545

[58] Field of Search ..... 340/691, 692, 573, 545, 340/603

[56] References Cited

U.S. PATENT DOCUMENTS

| | | | |
|---|---|---|---|
| 1,674,570 | 6/1928 | Re | 340/545 |
| 3,020,528 | 2/1962 | Swanson et al. | 340/573 |
| 3,634,846 | 1/1972 | Fogiel | 340/691 |
| 3,803,579 | 4/1974 | Compton | 340/573 |
| 3,890,465 | 6/1975 | Kaizu | 361/91 |
| 3,890,543 | 6/1975 | Jonassen | 361/91 |
| 3,938,120 | 2/1976 | O'Connell | 340/692 |
| 3,978,466 | 8/1976 | Simon | 340/545 |
| 4,001,613 | 1/1977 | Hills et al. | 340/573 |
| 4,100,581 | 7/1978 | Slark et al. | 340/692 |
| 4,212,007 | 7/1980 | Reyes et al. | 340/692 |
| 4,222,042 | 9/1980 | Cantley | 340/545 |
| 4,315,596 | 2/1982 | Johnson | 200/61.62 |
| 4,401,896 | 11/1983 | Fowler et al. | 340/666 |
| 4,532,498 | 7/1985 | Gilmore | 340/691 |
| 4,551,713 | 11/1985 | Aossey | 340/573 |
| 4,562,664 | 1/1986 | Kambic | 200/61.62 |
| 4,763,111 | 8/1988 | Matsuo | 200/61.62 |

*Primary Examiner*—Reinhard J. Eisenzopf
*Assistant Examiner*—Maura K. Regan
*Attorney, Agent, or Firm*—Terry M. Gernstein

[57] ABSTRACT

A warning system is adapted to warn someone to wash their hands prior to leaving or entering a facility in which hand washing is important. The system includes a door activated system that can be either visible or audible or both and can include a door locking system and a remote signalling system. The warning system is armed when the door is opened to permit entry into the facility and is de-activated upon the acutation of hand-washing facilities. In one embodiment, the system is used in a bathroom and the warning system can be activated by the flushing of a toilet.

13 Claims, 1 Drawing Sheet

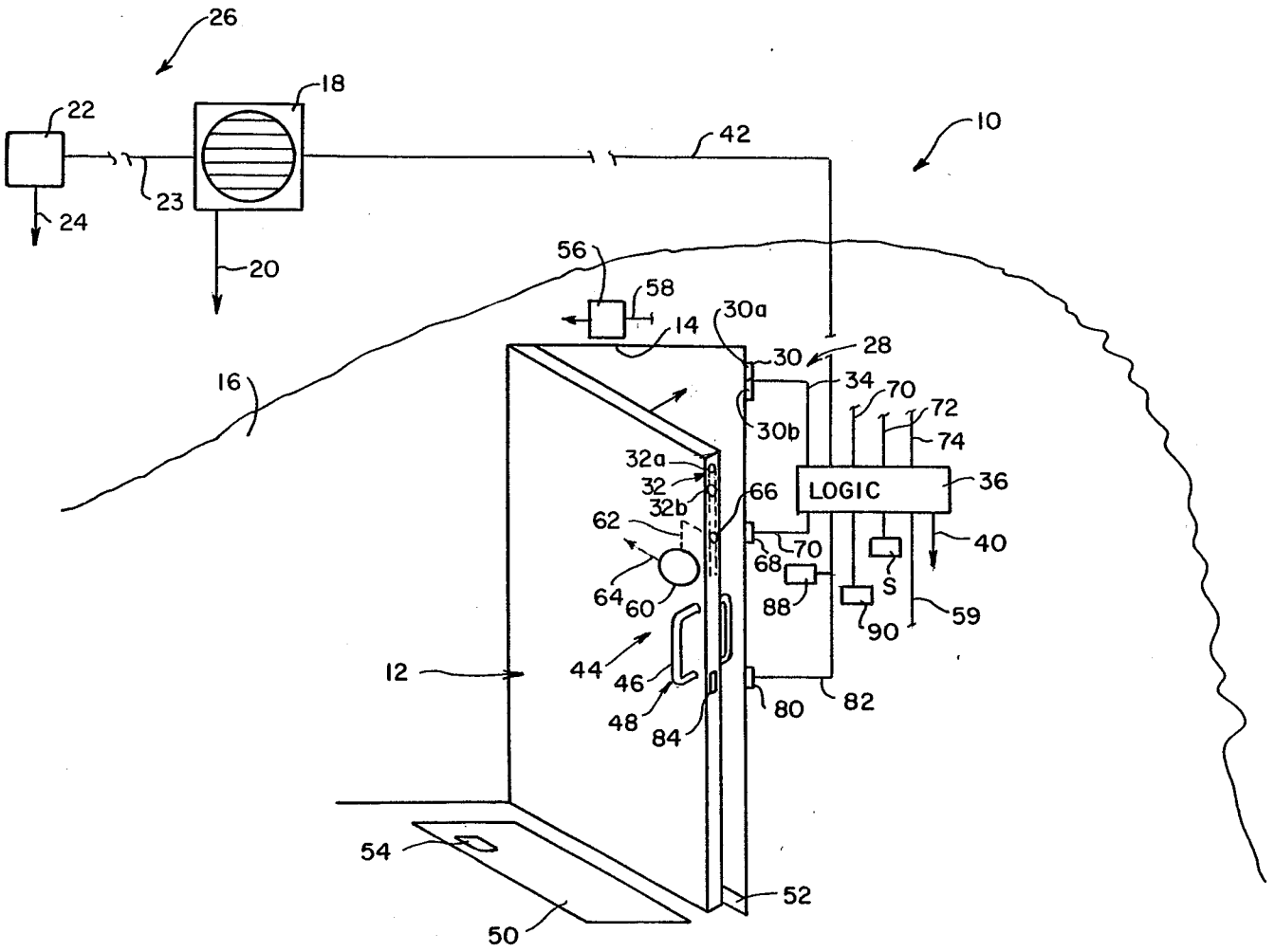
LOGIC
10
12
14
16
18
20
22
23
24
26
28
30
30a
30b
32
32a
32b
34
36
40
42
44
46
48
50
52
54
56
58
59
60
62
64
66
68
70
72
74
80
82
84
88
90
S

HAND WASHING ALERT

TECHNICAL FIELD OF THE INVENTION

The present invention relates to the general field of warning systems, and to a door-actuated system in particular. Specifically, the present invention relates to a system that is intended to aid in the prevention of the types of diseases that can be transmitted in a facility, such as a bathroom, by a failure to wash one's hands after using such facility.

BACKGROUND OF THE INVENTION

At the present time, many diseases, such as hepatitis, and the like, have been found to be transmittable due to a failure of people to wash their hands after using a public toilet. In fact, some public health laws require those in the food distribution field to wash their hands each time they enter the toilet facilities before they resume their duties.

For this reason, many facilities post signs which are intended to remind a person to wash their hands. However, such signs are easily ignored, and thus stronger warning systems are required if the spread of disease via bathrooms is to be checked.

While signs may be innocuous means of warning the public to wash after using a bathroom, even stronger warning means should be used for employees of a restaurant or other such food dispensing establishment. The present inventor is not aware of any warning system that is forceful enough to be commensurate with the degree of threat presently raised by such diseases as may be transmitted via a bathroom.

Accordingly, there is need for a warning system for use in a facility, such as a public bathroom, that is adapted to forcefully remind users of that facility to wash their hands prior to leaving the facility.

OBJECTS OF THE INVENTION

It is a main object of the present invention to warn people in a forceful manner to wash their hands prior to leaving a public facility.

It is another object of the present invention to warn people to wash their hands prior to leaving a bathroom.

It is another object of the present invention to warn employees of a food handling establishment to wash their hands prior to leaving a bathroom in a strong and forceful manner.

It is another object of the present invention to provide a warning system for use in a bathroom that reminds users of that bathroom to wash their hands and has can prevent such users form leaving the bathroom until hand-washing facilities have been operated.

SUMMARY OF THE INVENTION

These, and other objects, are accomplished by providing a warning system that is activated according to the ingress into and egress out of a bathroom, and warns, in a forceful manner, to wash hands. This warning can be either visible or audible or both. In some instances, the door can be locked in a manner that permits egress from the bathroom only after hand-washing facilities of that bathroom have been actuated.

The warning means of the present invention includes a switch and a switch activating means mounted on the door of the facility as well as sound equipment and/or visible warning means that are connected to the switch via a control unit to be activated after someone enters the bathroom and before that person leaves the bathroom.

The warning means can relay any desirable message, from a simple "Wash your hands" to a complete discussion of the type of diseases associated with bathrooms and public health laws and the like. The visible, audible and lock systems can be used separately or in conjunction with each other as desired.

In fact, a remote alarm device could be used in certain situations to warn that the bathroom has been used without the hand washing facilities being used. Such a situation might occur in areas where failure to use the hand washing facilities may be extremely dangerous, such as in laboratories requiring extremely clean and sanitary conditions, or where such failure could be extremely detrimental to the work being carried out at the laboratory. While such warning system may appear to be Draconian, there may be situations requiring such extreme measures. The present warning system can be adapted for use in such situations.

The audible message can be either electronic or human. If human, it might be desirable to use a man's voice in conjunction with a men's bathroom and a woman's voice in conjunction with a woman's bathroom.

The control unit can receive various signals to indicate which action to take, and such signals can be associated with the door, with various devices in the bathroom such as the flush mechanisms of the toilets, hand drying equipment, soap dispensing equipment, and water faucets, or a combination thereof. The control unit can also include various means, such as microporcessors or the like which can be programmed to carry out the functions associated with the control unit.

BRIEF DESCRIPTION OF THE DRAWING

The FIGURE schematically indicates the warning system embodying the present invention.

DETAILED DESCRIPTION OF THE PREFERRED EMBODIMENTS

Shown in the FIGURE is a warning system 10 which is adapted for use in a facility, such as a bathroom, where it is important for people to wash their hands before leaving that facility. The system warns the users of the facility to wash their hands, and is activated when the person enters the facility and before that person leaves the facility. As will be discussed below, the warning system is amendable to providing a simple warning, either visible or audible, or can be used to actually prevent someone form leaving the facility without washing their hands, or can notify someone in a remote location that the facility has been used and exited by someone who has failed to wash their hands.

The preferred form of the warning system 10 is actuated according to the opening and closing of an ingress/egress door 12 positioned and located to cooperate with a door frame 14 defined in a wall 16 of the facility. The door and the door frame are shown schematically, and could be any type of door as will occur to those skilled in the art, and no limitation is intended by the showing in the FIGURE as the particular door and frame system are not part of the invention per se.

The warning system 10 includes a speaker 18 which is located within the facility, and is positioned so that any audible messages broadcast by that speaker will be immediately heard by someone about to exit the facility via the door 12. For this reason, the speaker 18 is shown to one side of the door, but it is understood that such speaker could be located immediately adjacent to the door, or even in the door itself if suitable. The speaker 18 is connected to a source of power (not shown) via line connector 20, and such source can be a battery pack or utility power as is suitable.

The speaker 18 is also connected to a recorded message playing machine 22 via line connector 23, and the recorded message playing machine 22 is also connected to the source of power via line connector 24. The machine 22 can be a simple tape recorder that plays an endless tape repeating any suitable message, such as "Wash your hands", or the like.

The speaker 18 and the recorded message playing machine 22 form a system, that will be referred to as an audible system 26 for the sake of convenience.

The audible system 26 is activated to repeat the desired message by an activating system 28 that is controlled according to the opening and the closing of the door 12. The preferred form of the activating system 28 includes a switch 30 mounted in the door frame 14 and a switch activating means 32 mounted on the door to contact and actuate the switch 30 when the door 12 is opened and then closes. The switch 30 can have several different contacts that can be spaced apart to be activated by different members of the switch activating means 32 according to the function of the overall system that is desired. This feature will be apparent from the ensuing discussion. For example, one element **30*a* of the switch 30 is activated by an element 32*a* when a simple audible message is to be broadcast by the speaker 18; whereas, a second element 30*b* of the switch 30 will be activated by a second element 32*b* when a visible message is to be generated by the system 10, and so forth for other messages and/or combinations of messages and/or functions. As will be understood from the ensuing discussion, this concept can be used to lock and unlock the door in one application of the system. The switch can also be designed in a programmed manner to carry out the functions associated with the warning system 10**. The design of the switch will be evident to those skilled in the switch art to accomplish these different objectives and to carry out the different functions.

The switch 30 is connected via line conductor 34 to a control unit 36 that can be located in any convenient location and contains a microprocessor or like element for controlling the various functions and operations of the overall system 10. The microprocessor can be programmed in any manner known to those skilled in the art, and thus will not be further discussed per se.

The control unit is also connected to the power source via a line connector 40, and can include any suitable safeguard against undesired and possible spurious operation. Such safeguard can include a surge suppressor 42, such as is disclosed in U.S. Pat. Nos. 4,616,286, 3,890,543, 3,943,427, 4,023,071, 4,067,054, 4,068,279, 4,127,888 and 4,675,772, the disclosures of which are incorporated herein by reference. The surge protector is indicated in the FIGURE by the reference indicator S.

The control unit 36 is also connected to the speaker 18 and to the recorded message playing means 22 via a line connector 42.

As was mentioned above, the warning system 10 is designed to be armed when someone enters the room via the door 12 and is activated before that person leaves the room via the door 12. As is indicated in the FIGURE, a preferred form of the warning system 10 includes an arming system 44 to accomplish this objective. The arming system 44 includes sensors, such as sensor 46, located in the handles of the door, such as handle 48. The sensors are connected to a signal generator (not shown) that sends a signal to the control unit when the handle is grasped in a manner necessary to operate the door. Both the ingress handle and the egress handle and the sensors and signal generators associated therewith are identical, and thus, for the sake of simplicity, only one handle (the egress handle) is shown in the FIGURE.

For example, if someone grasps the egress handle on the inside of the room in a room-exiting situation, the sensor associated with such egress handle will be activated to send a signal to the control unit for appropriately activating the audible system 26 to play the recorded message before the person leaves the room. An identical arming system is associated with the ingress handle to signal the control unit to begin the arming sequence.

Instead of the sensors associated with the door handles, pressure pads, such as an egress pressure pad 50 and an ingress pad 52 and the associated signal generators, such as signal generator 54 associated with the egress pad, can be used to determine if a person is entering the room or leaving the room. Presence detectors, such as are used in conjunction with door operating systems or intrusion alarms, can also be used, and such a detector is indicated by the reference numeral 56. An example of such a presence detector is disclosed in U.S. Pat. No. 4,742,549, the disclosure of which is incorporated herein by reference. Both ingress and egress detectors will be used, but only the egress detector is shown in the FIGURE for the sake of simplicity, and both are connected to the control unit via line connectors, such as line connector 58, and to the power source.

Instead of an ingress pad or ingress signal, the control unit can be connected directly to a toilet via a line conductor 59 to arm the system only when the toilets of the room have been used.

Alternatively, the audible system 26 can be activated as soon as someone enters the room and will be turned off only upon the activation of hand-washing facilities.

As mentioned above, the warning system 10 can include a visible means. Such a visible means is indicated in the FIGURE as light 60 mounted on the door immediately adjacent to the egress handle. This light is connected to the control unit by line connector 62 and to the source of power via a line connector 64 and contains a suitable message, such as "Wash your hands". The light can either flash or be activated as soon as someone enters the room.

The control unit 36 can include logic to turn the light off as soon as someone leaves the room. Thus, a switch 66 is located in the door and a switch activating element 68 is positioned in the door frame, with the switch activating element 68 being connected to the control unit 36 by a connector 70. As before, the visible system is armed and activated according to the sensors in the handles of the door or the like. The control unit 36 will arm the switch activating element 68 to operate the switch 66 when the door closes after it has been opened to permit ingress to the room. When the door closes after permitting ingress, the light 60 is turned on by the switch 66. The control unit then is activated by the hand-washing facilities to operate the switch activating element 68 in a manner to turn off the light 60 when the hand-washing facilities have been operated. The switch 66 can include logic to permit such operation as will occur to those skilled in the switch art. Thus, the further details of the switch and the switch activating element 68 will not be presented.

The audible signalling system 26 can also be located in the door and thus can be activated and controlled in a manner similar to the visible means just discussed using a switch mounted in the door and a switch activating element mounted on the door frame in a manner similar to the just-discussed switch 66 an switch activating element 68.

As was also mentioned above, the system is disarmed, that is the signal will not be activated, if the person using the facilities washes their hands. To disarm the system, the facility can include disarming means associated with the hand washing facilities in the room and connected to the control unit. Thus, for example, the sink faucets can include a signal generator that sends a signal to the control unit via a line conductor 70 when a faucet is turned on to disarm or turn off the signal; or a warm-air hand drying unit can include a signal generator that sends a signal to the control unit via a line conductor 72 to disarm or turn off the warning signal when the hand dryer is activated; or the soap dispensers can include signal generators to signal the control unit 36 via a connector 74.

As also mentioned above, in some situations, the consequences of not washing one's hands after using the bathroom are so dire as to require extreme measures to ensure that hands are always washed after using the bathroom.

In such extreme situations, the door 12 can be locked after entry and only unlocked after the hand washing facilities have been used. The control unit 36 and the ingress and egress signalling systems can be used to carry out this function. For this, the system 10 includes a door locking element 80 on the door frame and connected to the control unit 36 via a line connector 82 and adapted to co-operate with a locking mechanism 84 on the door to prevent opening of the door unless the hand washing facilities have been activated. Upon activating a hand-washing facility, a signal can be sent to the control unit 36 to unlock the door via the just-described door locking system. An override system can be included if desired, and such override system is indicated by the reference numeral 88. The override system can be activated using appropriate controls located either inside or outside the bathroom as desired. In the alternative, a remote location can be signalled via a signal generator 90 associated with the control unit that the bathroom has been used and the hand-washing facilities have not been used and the door has been opened to permit egress. The aforementioned systems and signal generators can be used for this function and the control unit 36 can be appropriately programmed for this signalling function.

It is to be understood that while certain forms of the present invention, such as a means for signalling and warning before a person exits a room, or preventing exit from a room prior to washing hands, have been illustrated and described herein, it is not to be limited to the specific forms or arrangement of parts described and shown, and could be extended to other situations, such as actually preventing ingress to a room or reminding someone to wash their hands prior to ingressing to a room, such as a dinning facility, or a clean room or a laboratory, or the like.

I claim:

1. A warning means for use in a facility and which is adapted to remind people to wash their hands prior to leaving the facility, comprising:

a frame-mounted switch mounted on a door frame of an ingress/egress door of a facility which includes a handwashing means;

a switch activating means mounted on the ingress/egress door in a position to actuate said frame-mounted switch;

a recorded message playing means;

a recorded message on said recorded message playing means that is adapted to remind someone to wash their hands;

a speaker means connected to said recorded message playing means and located in the facility for broadcasting said recorded message in the facility;

an egress switch means mounted to be activated by a person prior to such person exiting the facility;

a control unit connecting said frame-mounted switch and said egress switch to said recorded message playing means and activating said playing means after said frame-mounted switch has been actuated by said door being opened to permit someone to enter the facility and after said egress switch has been activated prior to said door being opened to permit someone to exit the facility;

power means connected to said frame-mounted switch, to said egress switch means, to said control unit, to said recorded message playing means and to said speaker means;

a visible alarm mounted in the facility adjacent to said door and connected to said control unit to be activated when said recorded message playing means is activated, said visible alarm containing a message adapted to remind someone to wash their hands, and means connected to said visible alarm to deactivate said visible alarm after a person has exited the facility, said visible alarm being connected to said power means; and a lock on said door and a lock control means connected to said door lock and to said control unit to prevent said door from being opened to permit egress from the facility until said facility hand washing means has been activated, said lock and said lock control means being connected to said power means.

2. The warning means defined in claim 1 wherein the door includes a egress handle located inside the facility and a ingress handle located outside the facility, each of said handles including a signal generating means which is connected to said control unit for sending a signal to said control unit when the handle associated therewith is grasped to open said door for identifying which handle has been used to operate said door.

3. The warning means defined in claim 2 wherein said handwashing means includes a warm air generating hand dryer.

4. The warning means defined in claim 2 wherein said handwashing means includes a soap dispenser.

5. The warning means defined in claim 2 wherein said handwashing means includes a water-dispensing faucet.

6. The warning means defined in claim 1 further including an ingress pressure pad located outside the facility adjacent to said door and an egress pressure pad located inside the facility adjacent to said door, means in each of said pressure pads for generating an electric signal when a person steps on said pressure pad when moving through said door, and means connecting the pressure pad signal generating means of each of said pressure pads to said control unit for sending a signal to said control unit when the pressure pad associated therewith has been stepped on by a person passing through the door for permitting said control unit to identify whether said door is being opened to permit ingress to the facility or to permit exit from the facility according to whether said ingress pressure pad signal is received by said control unit or said egress pressure pad signal is received by said control unit, each of said pressure pad signal generating means being connected to said power means.

7. The warning means defined in claim 1 wherein said lock control means includes lock de-activating means for de-activating said lock when someone attempts to open the door to enter the facility, said lock de-activating means being connected to said power means.

8. The warning means defined in claim 1 wherein said speaker means is located adjacent to said door.

9. The warning means defined in claim 1 further including a surge protector connected to said control unit.

10. The warning means defined in claim 1 further including signal generating means connected to a toilet element in the facility and to said control unit.

11. The warning means defined in claim 1 further including a remote signalling means connected to said control unit.

12. The warning means defined in claim 7 further including a door lock control means includes an override means.

13. The warning means defined in claim 1 further including a presence detector located adjacent to the door.

* * * * *